US006175187B1

(12) United States Patent
Tsutsui

(10) Patent No.: US 6,175,187 B1
(45) Date of Patent: Jan. 16, 2001

(54) DUAL TUBE FLUORESCENT LAMP AND LIGHT DEVICE

(75) Inventor: Naoki Tsutsui, Yokosuka (JP)

(73) Assignee: Toshiba Lighting & Technology Corp., Tokyo (JP)

( * ) Notice: Under 35 U.S.C. 154(b), the term of this patent shall be extended for 0 days.

(21) Appl. No.: 09/249,554

(22) Filed: Feb. 12, 1999

(30) Foreign Application Priority Data

Feb. 12, 1998 (JP) ..... 10-030168

(51) Int. Cl.[7] ..... H01J 1/62
(52) U.S. Cl. ..... 313/493; 313/573; 313/634
(58) Field of Search ..... 313/493, 573, 313/634, 25, 27

(56) References Cited

U.S. PATENT DOCUMENTS 5,753,999 * 5/1998 Roozekrans et al. ..... 313/493 X
5,804,914 * 9/1998 Ozawa et al. ..... 313/493
6,008,567 * 12/1999 Aizawa et al. ..... 313/493 X

* cited by examiner

*Primary Examiner*—Ashok Patel
(74) *Attorney, Agent, or Firm*—Pillsbury Madison & Sutro LLP

(57) ABSTRACT

A dual tube type fluorescent lamp including a luminescence tube. The luminescence tube has a long and slender airtight glass bulb with a nonlinear form part, a pair of electrodes and a phosphor layer formed on the inside surface of the glass bulb. A gap is formed between the circumference of the luminescence tube and an outside glass tube. The luminescence tube encloses an electric discharge medium coating mercury and a rare gas. An inorganic substance layer is formed at least at the nonlinear form part either on the outer surface of the luminescence tube, on the inner surface of the outside glass tube, or both. The inorganic substance layer has a softening point higher than the softening point of the glass.

16 Claims, 5 Drawing Sheets

DUAL TUBE FLUORESCENT LAMP AND LIGHT DEVICE

INCORPORATION BY REFERENCE

This application incorporates the subject matter of Japanese Patent Application 10-30168 filed Feb. 12, 1998 as if fully set forth herein.

BACKGROUND OF THE INVENTION

1. Field of the Invention

The present invention relates to a dual tube fluorescent lamp and a lighting device using the dual tube fluorescent lamp. The dual tube arrangement includes an inner luminescence tube contained within an outer tube.

2. Description of Related Art

Although it is known to use a dual tube type fluorescent lamp, there is a perceived need to provide a dual tube fluorescent lamp which is bent to a predetermined shape that may include one or more bent or nonlinear portions.

The manufacture of a dual tube type fluorescent lamp having a nonlinear portion by known methods is rather complicated. After manufacturing a substantially linear dual tube type fluorescent lamp, a portion of it must be bent. The portion to be bent into some nonlinear shape is heated over a gas flame or by an electric furnace. The outer glass tube and the inner luminescence tube are softened and then bent into the desired shape.

During this heating and bending it becomes difficult to control both the inner luminescence tube and the outer tube such that they do not come into contact with one another. If they do, either or both of the tubes will become mis-shaped or ruined. Also, cracks may form in one or both of the tubes. There has been a need to find a better way of manufacturing dual tube type fluorescent lamps having non-linear portions.

SUMMARY OF THE INVENTION

Accordingly, a primary object of the present invention to provide a dual tube type fluorescent lamp having one or more bent or non-linear portions and a lighting device using such a lamp. The dual tube type fluorescent lamp includes an inner fluorescence tube and an outer glass tube containing the inner fluorescence tube.

Another object of the invention is to provide a method of manufacturing a dual tube type fluorescent lamp that does not cause the tubes of the lamp to crack during manufacture and which does not allow defects to occur by virtue of the inner and outer tubes coming into contact with one another during the manufacturing process.

The dual tube type fluorescent lamp according to the invention has an inner fluorescence tube and an outer tube containing the inner fluorescence tube. It has at least one non-linear or bent portion. A pair of electrodes, one located near each tube end, provide a means for applying electric power to the lamp. A phosphor layer is formed in the inside of the inner fluorescence tube. There is a gap between the inner and outer tubes. The inner luminescence tube contains mercury and a rare gas providing an electric discharge medium. An important aspect of the invention is the use of a layer of material that has a softening point higher than the softening point of glass. This layer of material is applied either to the outer surface of the inner tube or to the inner surface of the outer tube or both, at least at portions of the inner and outer tubes that are to be bent or formed into non-linear portions.

Various embodiments of the invention will be described in detail with reference to the following drawings.

BRIEF DESCRIPTION OF THE DRAWINGS

The invention will be described in more detail below with reference to the following figures.

Preferred embodiments of the invention will be described with reference to the accompanying drawings. Throughout the drawings, like reference numerals designate like or corresponding parts or elements. Duplicative description will be avoided as much as possible.

DETAILED DESCRIPTION OF THE INVENTION

Figure 1:
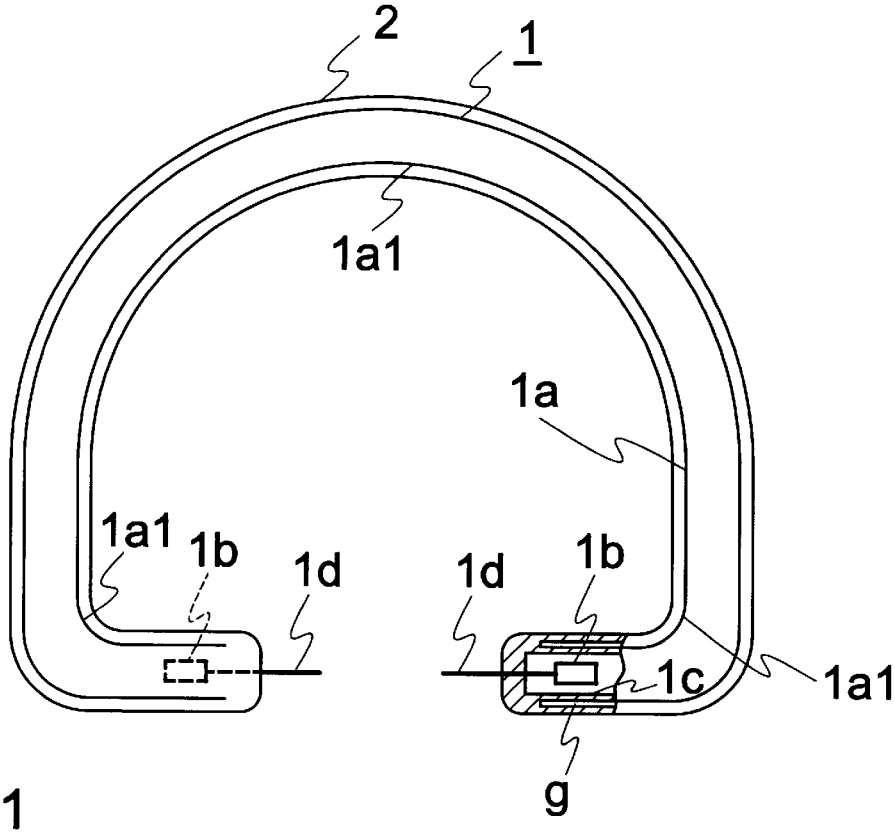
FIG. 1 is a front view of a dual tube type fluorescent lamp according to a first embodiment of the invention.
Figure 2:
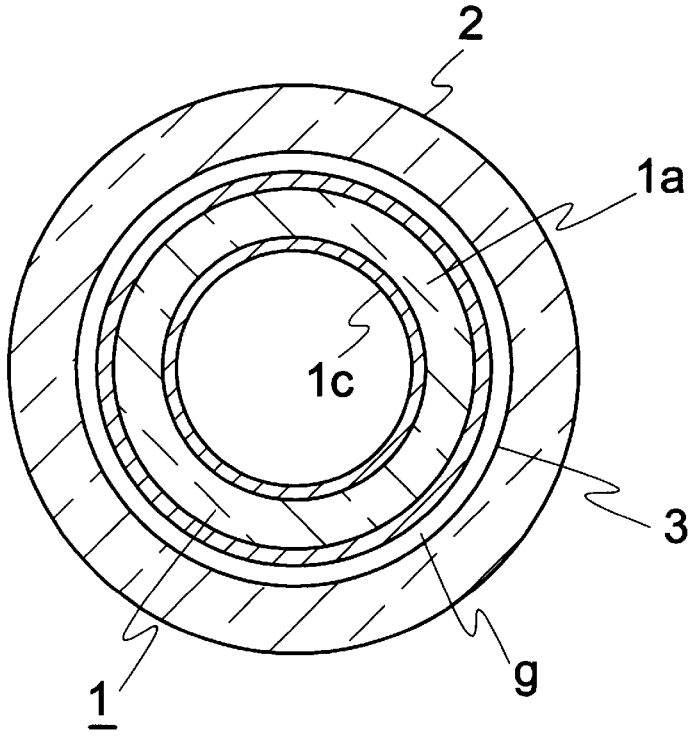
FIG. 2 is an enlarged sectional view of an essential part of the first embodiment shown in FIG. 1.

A first embodiment of the present invention will be explained with reference to FIGS. 1 and 2. FIG. 1 is a front view of a dual tube type fluorescent lamp according to a first embodiment of the invention and FIG. 2 is an enlarged sectional view of an essential part of the first embodiment shown in FIG. 1. The basic parts of the lamp include an inner luminescence tube 1 surrounded by an outer tube 2. A layer 3 of inorganic material that has a softening point higher than the softening point of glass is applied either to the outer surface of the inner tube or to the inner surface of the outer tube or both, at least at portions of the inner and outer tubes that are to be bent or formed into non-linear portions.

Tube 1 comprises a glass bulb 1*a*. A pair of electrodes 1*b* allow for power to be applied to the tube. A phosphor layer 1*c* is formed on an inner surface of bulb 1*a*. Lead lines 1*d* conduct electric power to the electrodes 1*b*. An electric-discharge medium is provided within the bulb. Both ends of the tube 1 are made of an borosilicate glass and are sealed. Bulb 1*a* is airtight and has a nonlinear form part 1*a*1, that, in this embodiment, is somewhat circular. Nonlinear form part 1*a*1 is formed at a central portion of tube 1. Tube 1 also has a portion near each end that has substantially a right angle bend. Electrodes 1*b* are preferably of the cold cathode type, but other suitable electrodes could be used. The electrodes are fixed and sealed at respective ends of glass bulb 1*a*. Phosphor layer 1*c* is a three (3) wave luminescence type and is formed on an inside surface of glass bulb 1*a* at the thickness of about 5 micrometers. An electric-discharge medium is enclosed within bulb 1*a*. This medium can be mercury and argon or various other suitable materials.

The principles of the invention can be applied in many different ways, some examples of which are shown in the various embodiments. For example, glass bulb 1*a* can be made of hard glass, such as flexible glass, such as soda lime glass or lead glass, or it could be made of a half-hard glass.

While the inner tube is long and slender, it is sealed. The tube is later bent/curved into the desired shape. When we refer to a bulb as having a non-linear portion or shape we intend to include all kinds of non-linear shapes such as curved portions, bent portions, crooked portions, etc. Our definition includes but is not limited to the shapes required for bulb types: half-circular, L type, U type, W type, Bulidge type, etc. The cross-sectional form of the glass bulbs are usually circular, but they may be of other shapes. Also, the bulbs may be of various sizes. For example, our dual tube lamps can be comparatively compact and thin so that they can be used for back lights, such as for liquid crystal displays and for meter panels for automobiles and the like. The outside diameter of our lamps can be 3 mm or less in the extreme. Although generally they are optimally 4 mm or less and preferably 8 mm or less. Preferably, the tubes have a thickness of less than 1 mm, 0.1~0.7 mm preferably, and optimally about 0.3 mm. The tubes can be constructed of various lengths. It is presently preferable for the length to be 50~250 mm, and optimally 30~400 mm.

Electrode 1*b* is preferably of the cold cathode type for dual tube type fluorescent lamps that are comparatively compact. However hot cathode type electrodes can be used where suitable. Other suitable electrodes can also be used. A phosphor layer 3 may be indirectly formed in the inner tube through a protection film. The particular type of phosphor used is based on the use of the lamp. For example, in the case of the dual tube type fluorescent lamp for reading, the phosphor might be a monochrome luminescence phosphor or the like. The phosphate phosphor (LaPO4:Ce3+, Tb3+) of the rare earths can be used. For back lights, the phosphor of the luminescence color of white systems, such as the 3 wave luminescence type phosphor or the halo Lynn phosphor, can be used.

The electric-discharge medium contains mercury and a rare gas as mentioned above. Mercury generates an ultraviolet ray by low-pressure mercury steamy electric discharge. The rare gas acts as starting gas and buffer gas.

Although pure mercury can be enclosed directly, as mercury in the inner tube, one preferred way of inserting the mercury is to insert a mercury filled capsule containing a desired quantity of mercury into the tube. The capsule is then destroyed after enclosure in the tube and the mercury is set free within the tube. The mercury can also be inserted into the inner tube in the form of an amalgam. The rare gas can comprise argon, neon, the krypton and a xenon, singly or in a mix.

Outer tube 2 is made of a borosilicate glass which is of substantially the same quality of the material from which glass bulb 1*a* is made. Bulb 1*a* and tube 2 are positioned with respect to each other such that there is a gap g formed between the outer surface of bulb 1*a* and the inner surface of outer tube 2. Outer tube 2 surrounds glass bulb 1*a* completely. The positions of bulb 1*a* and tube 2 are fixed with respect to each other because they are both secured with respect to each other in the vicinity of their respective end portions. The inside of tube 2 is maintained at a low pressure, about 66 Pa.

Outer tube 2 can be fabricated from a different material, if desired, although it is desirable to use glass of the same quality of the material as a glass bulb. There are no special limitations of the size of the outer tube. However, the diameter of the outside tube can be as small as 5 mm or less. Generally it is optimum to be 8 mm or less and preferably 10 mm or less. Generally, the thickness is less than 1 mm, 0.1~0.7 mm preferably. It is the optimum about 0.3 mm. Furthermore, the length of the outer tube just surrounds the inner luminescence tube. Although there is generally a gap g between the inner and outer tubes, the tubes can touch in certain places, such as near the ends where they join and are fixed with respect to one another. They may also touch in other places. Also, it is possible to form a vacuum in the outer tube and enclose a low pressure rare gas therein. Mercury can be enclosed as required.

An inorganic substance layer 3 is formed on either the outer surface of bulb 1*a* or the inner surface of tube 2 or both. The layer 3 is preferably made of gamma alumina. It includes a plurality of particles having a diameter on the order of 0.5 micrometer. The thickness of layer 3 is generally 1–5 micrometers. Glass bulb 1*a* has a nonlinear form part 1 al formed by bending the tubes around a jig. During bending, if glass bulb 1*a* and the outer tube come into contact with one another at nonlinear form part 1*a*1, layer 3 intervenes and prevents damage from occurring. The inorganic substance layer 3 has not softened because its softening point is selected to be higher than that of the glass tubes being heated and bent. Thus, the use of layer 3 prevents the glass tubes from cracking. The dual tube type fluorescent lamp of this embodiment can be used in a variety of ways including as the back lights which illuminate a dashboard meter panel for an automobile.

Inorganic substance layer 3 is preferably a transparent material. For example, alumina, silica, titania. There are different types of alumina, such as alpha alumina and gamma alumina. Gamma alumina is transparent. It is desirable to not interfere with the luminescence of the phosphor. Layer 3 can be formed on the inside surface of the outer tube or on the outer surface of the inner tube or on both. It is desirable to have layer 3 present where there is a possibility of inner and outer tubes coming into contact with one another during bending. Layer 3 can be formed over the entire length of concentric inner and outer tubes if desired. The inorganic substance layer 3 can be applied and formed in various ways. For example, a mixture with a suitable solvent could be made and applied to distribute the particles over the surfaces that might come into contact during bending. The solvent mixture could then be dried and baked. It could also be formed using an Aca moisture solution of a metal alkoxide.

Figure 3:
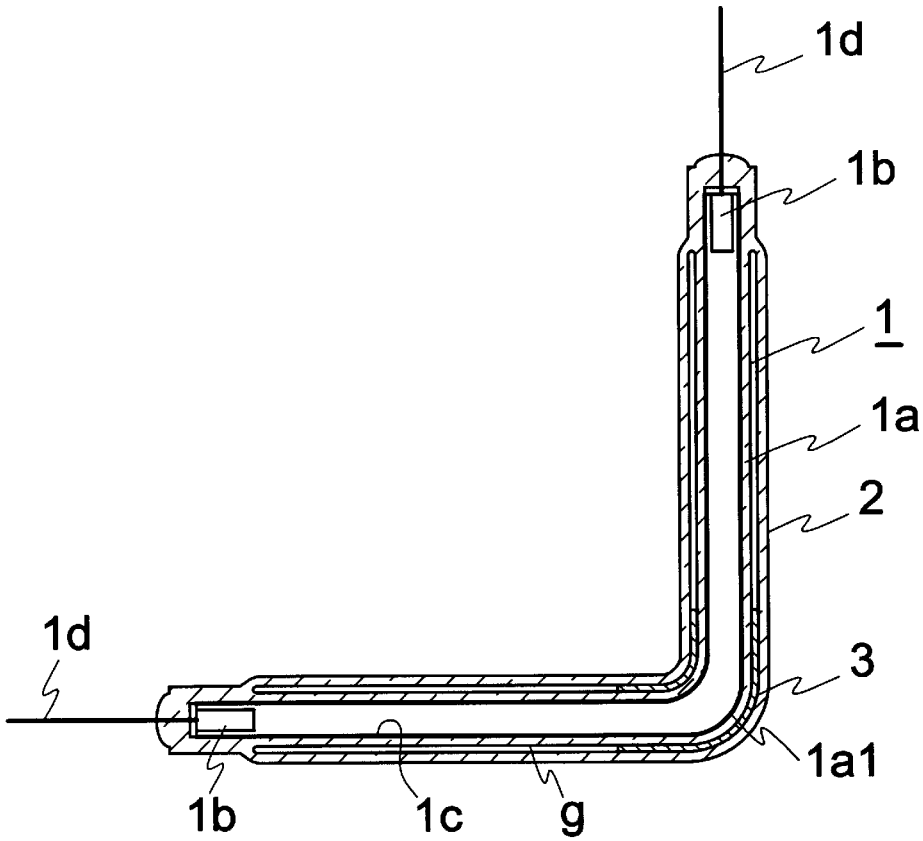
FIG. 3 is a front view of a second embodiment of the invention.
Figure 4:
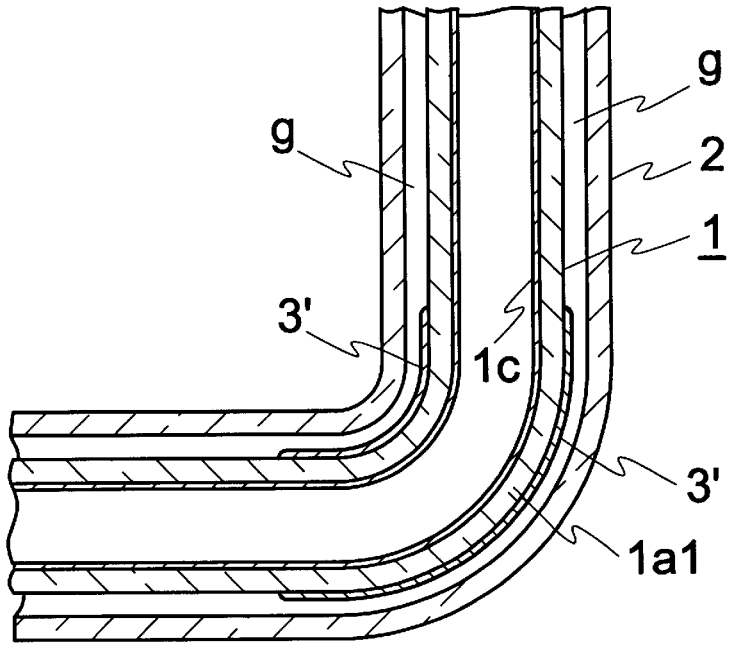
FIG. 4 is an enlarged sectional view of an essential part of the second embodiment of the present invention.

FIG. 3 is a front view of a second embodiment of the invention. FIG. 4 is an enlarged sectional view of an essential part of FIG. 3. Reference numerals that are the same as those used in the description of the previous embodiment will not be further explained.

In this embodiment the inorganic substance layer 3 is formed only at that portion of the tube which is formed into a nonlinear portion 1*a*1. Tube 1 is shaped to be substantially right-angled in a central portion thereof. Thus, luminescence tube 1 has the general shape of the letter "L".

Inorganic substance layer 3' consists essentially of alpha alumina, and is located only near nonlinear form part 1*a*1 of the glass bulb 1*a*. Even though the transparency of alpha alumina is inferior when compared with that of gamma alumina, the nonlinear portion 1*a*1 of the tube is not so important. Thus, the use of alpha alumina is satisfactory. Of course gamma alumina or other suitable inorganic substances could be used in place of the alpha alumina.

Glass bulb 1*a* has a outside diameter of 1.6 mm and an inside diameter of 1.0 mm. The glass bulb 1*a* containing an electric-discharge medium of mercury and a rare gas as neon and argon at a pressure of 0.6 kPa.

The outer tube 2 has an outside diameter of 3.0 mm and an inside diameter of 2.0 mm. There is a gap g of 0.2 mm between tubes. The gap space g filling argon of 66 Pa. Inorganic substance layer 3 is formed on the nonlinear portion 1*a*1 on the outside of bulb 1*a*. The Inorganic substance layer 3 is Alpha alumina with a particle diameter of about 5 micrometers . The thickness of layer 3 is about 10–50 micrometers over a length of about 20 mm. Layer 3 of gamma alumina intervenes between glass bulb 1*a* and outer tube 2. Since the inorganic substance layer 3 has not softened when the tubes have been heated and softened, the portions of glass tubes that would otherwise come into contact are buffered and prevented from becoming damaged during tube bending.

This embodiment of the dual tube type fluorescent lamp can be advantageously used to provide a back light for liquid crystal display of the side light type.

Figure 5:
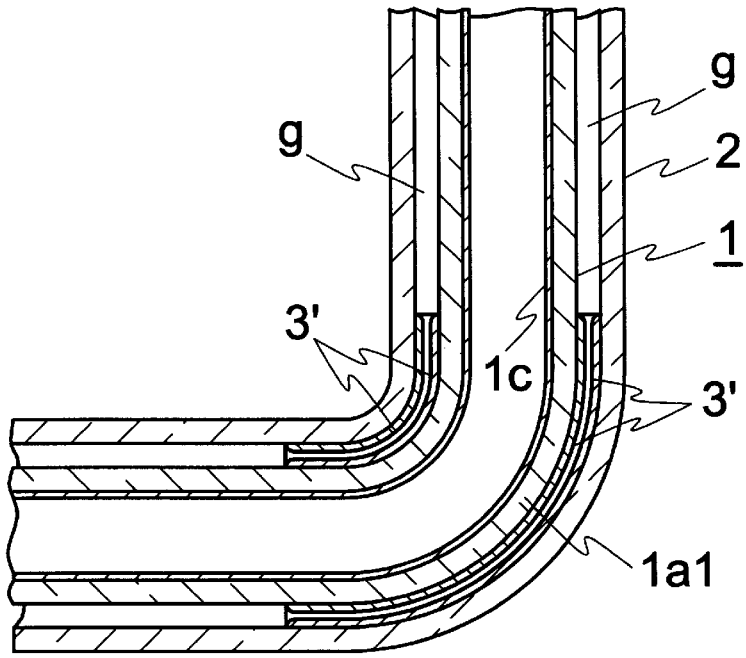
FIG. 5 is a essential part enlarged sectional view of a third embodiment of the invention.

FIG. 5 is an enlarged sectional view of an essential part a third embodiment of the invention. This embodiment form differs from the second embodiment in that the inorganic substance layer 3' is formed on both the inside surface of the outer tube and the outer surface of the inner tube. That is, alpha alumina is applied also to the inside of tube 2 to a thickness of about 10–50 micrometers.

Figure 6:
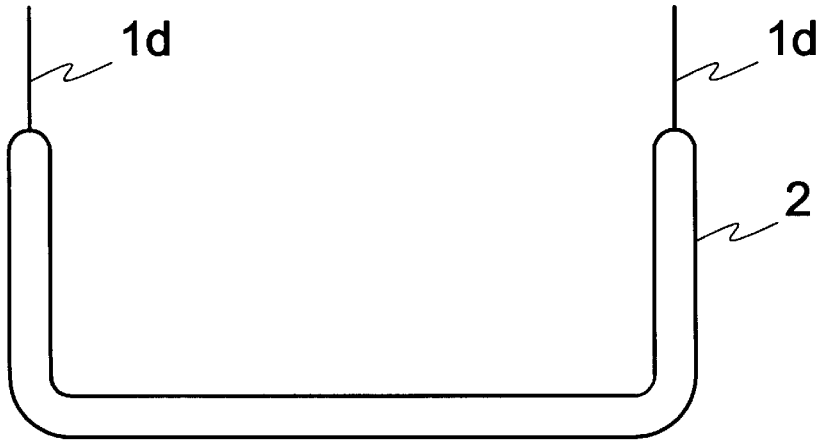
FIG. 6 is a front view of a forth embodiment of the invention.
Figure 7:
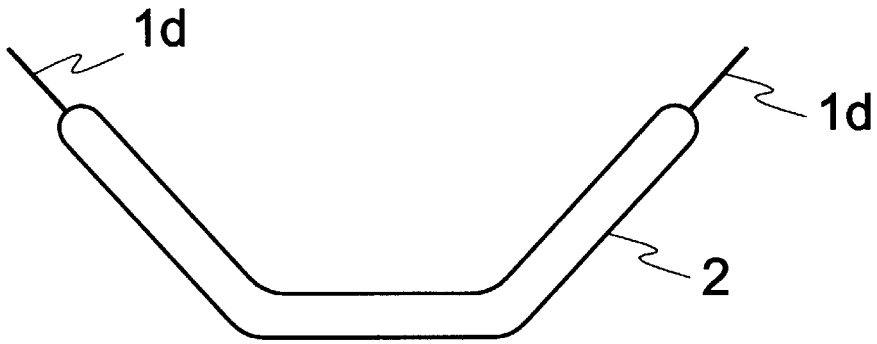
FIG. 7 is a front view of a fifth embodiment of the invention.

FIG. 6 is a front view of a fourth embodiment of the invention. FIG. 7 is a front view of a fifth embodiment of the invention. Reference numerals that are the same as those shown in the previously described embodiments will not be further explained. The fourth embodiment form differs from the others in that the dual tube type fluorescent lamp is shaped in so as to represent a character. The lamp of the fifth embodiment is shaped as a reverse trapezoid.

Figure 8:
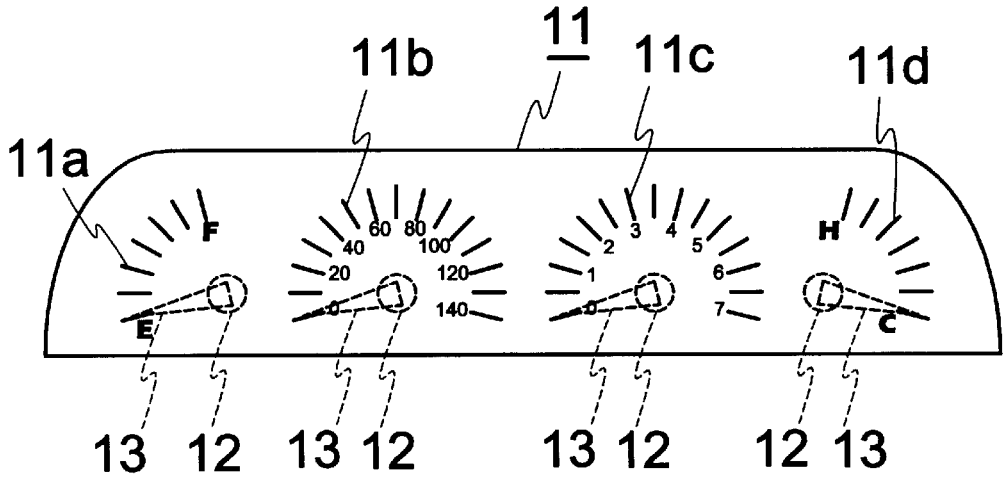
FIG. 8 is a front view of a meter display panel for an automobile utilizing the invention.

FIG. 8 shows a lighting device according to the present invention. In this embodiment, the lighting device is formed so as to be useful as a display panel for an automobile. This is a front view of a display panel 11 including, from left to right, a fuel meter portion 11*a*, speedometer portion 11*b*, a tachometer portion 11*c*, and a water-temperature portion 11*d*. Individual luminescent portions can be activated to indicate a read out to the driver. Parts 11*a*, 11*b*, 11*c* and 11*d* have transparent portions to allow light to reach the driver. An indicator 13 effectively visually rotates about an axis 12.

Figure 9:
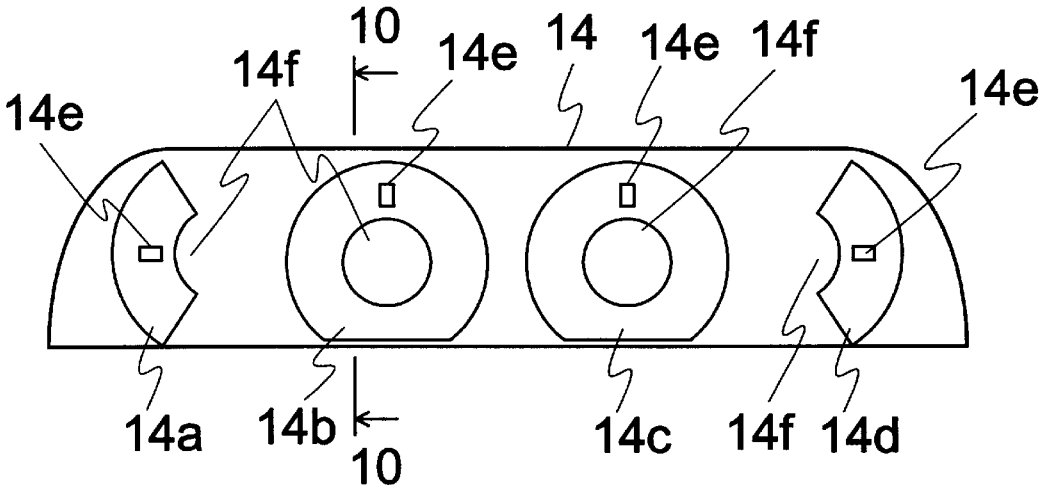
FIG. 9 is a front view showing a reflective panel of the FIG. 8 embodiment.
Figure 10:
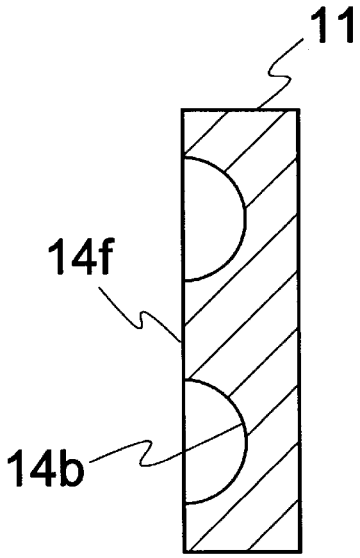
FIG. 10 is a sectional view along line 10—10 of FIG. 9.

FIG. 9 is a front view showing a reflective panel 14 for use with the display panel 11 shown in FIG. 8. FIG. 10 is a sectional view taken along line 10—10 of FIG. 9. A reflective panel 14 is located behind display panel 11. Reflective sides 14*a*, 14*b*, 14*c*, and 14*d* are formed in portions which correspond with portions 11*a*, 11*b*, 11*c*, and 11*d*, respectively. Lamp holders 14*e* are provided for each of reflective sides 14*a*, 14*b*, 14*c* and 14*d*. Also, each of reflective sides 14*a*, 14*b*, 14*c* and 14*d* is provided with a meter portion 14*f*.

A dual tube type fluorescent lamp (not shown) can be formed as a concave reflective panel 14. Reflective panel 14 has reflective sides 14*a*, 14*b*, 14*c*, and 14*d* as shown in FIG. 10. A lampholder 14*e* supports a dual tube fluorescent lamp.

Dual tube fluorescent lamps can thus be used as indicators by lighting appropriately shaped tubes to perform a read out for the driver that simulates a movable needle. For example, dual tubes can be formulated in the shape of quarter circles to indicate quadrants of a meter. Tubes can be fabricated in a shape to match the outline of each meter support part. A dual tube fluorescent lamp in the shape of ¼ circles can be used for a fuel meter and a water-temperature meter. A dual tube fluorescent lamp in the shape of modified circle is shown in FIG. 1 for use as a speedometer or a tachometer.

In addition to the embodiments already described and illustrated, many alternatives are possible. The lighting device could be shaped and arranged for many different applications. There are many office equipment applications that can make use of this invention. For examples: copy machines, scanners, facsimile, etc. Back lighting devices include meter panels for automobiles, lighting instruments, display equipment, picture reading equipment, etc.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claimed is:

1. A dual tube type fluorescent lamp comprising:

a luminescence tube including an airtight glass bulb having a bent portion, containing an electric-discharge medium, a pair of electrodes, and a phosphor layer formed on the inside surface of the glass bulb;

an outside glass tube, generally surrounding the luminescence tube and positioned in such a manner that, except for where the outside glass tube and the luminescence tube are attached, there is a gap therebetween; and an inorganic substance layer, which has a softening point higher than the softening point of glass, formed at least at the bent portion either on the outer surface of the luminescence tube, or on the inner surface of the outside glass tube, or both.

2. A dual tube type fluorescent lamp comprising:

a luminescence tube including an airtight glass bulb having a non-linear portion, containing an electric-discharge medium, a pair of electrodes, and a phosphor layer formed on the inside surface of the glass bulb;

an outside glass tube, generally surrounding the luminescence tube and positioned in such a manner that, except for where the outside glass tube and the luminescence tube are attached, there is a gap therebetween; and an inorganic substance layer, which has a softening point higher than the softening point of glass, formed at least at the non-linear portion either on the outer surface of the luminescence tube, or on the inner surface of the outside glass tube, or both.

3. A fluorescent lamp as set forth in claim 1, wherein the inorganic substance layer is formed in the gap between the luminescence tube and the outside glass tube substantially formed over the full length of both.

4. A fluorescent lamp as set forth in claim 2, wherein the inorganic substance layer is formed in the gap between the luminescence tube and the outside glass tube substantially formed over the full length of both.

5. A fluorescent lamp as set forth in claim 1, wherein the layer of inorganic substance is gamma alumina.

6. A fluorescent lamp as set forth in claim 2, wherein the layer of inorganic substance is gamma alumina.

7. A dual tube type fluorescent lamp as set forth in claim 1, wherein an inorganic substance layer being transparent alumina.

8. A dual tube type fluorescent lamp as set forth in claim 2, wherein an inorganic substance layer being transparent alumina.

9. A light device comprising:

a light device body;

a light control means for controlling light; and a dual tube type fluorescent lamp comprising:

a luminescence tube including an airtight glass bulb having a bent portion, containing an electric-discharge medium, a pair of electrodes, and a phosphor layer formed on the inside surface of the glass bulb;

an outside glass tube, generally surrounding the luminescence tube and positioned in such a manner that, except for where the outside glass tube and the luminescence tube are attached, there is a gap therebetween; and an inorganic substance layer, which has a softening point higher than the softening point of glass, formed at least at the bent portion either on the outer surface of the luminescence tube, or on the inner surface of the outside glass tube, or both.

10. A light device as set forth in claim 9, wherein the inorganic substance layer is formed in the gap between the luminescence tube and the outside glass tube substantially formed over the full length of both.

11. A light device as set forth in claim 9, wherein the layer of inorganic substance is gamma alumina.

12. A light device as set forth in claim 9, wherein an inorganic substance layer being transparent alumina.

13. A light device comprising:

a light device body;

a light control means for controlling light; and a dual tube type fluorescent lamp comprising:

a luminescence tube including an airtight glass bulb having a non-linear portion, containing an electric-discharge medium, a pair of electrodes, and a phosphor layer formed on the inside surface of the glass bulb;

an outside glass tube, generally surrounding the luminescence tube and positioned in such a manner that, except for where the outside glass tube and the luminescence tube are attached, there is a gap therebetween; and an inorganic substance layer, which has a softening point higher than the softening point of glass, formed at least at the non-linear portion either on the outer surface of the luminescence tube, or on the inner surface of the outside glass tube, or both.

14. A light device as set forth in claim 13, wherein the inorganic substance layer is formed in the gap between the luminescence tube and the outside glass tube substantially formed over the full length of both.

15. A light device as set forth in claim 13, wherein the layer of inorganic substance is gamma alumina.

16. A light device as set forth in claim 13, wherein an inorganic substance layer being transparent alumina.

* * * * *